US006157108A

United States Patent [19]

Potocnik et al.

[11] Patent Number: 6,157,108

[45] **Date of Patent: *Dec. 5, 2000**

[54] COMMUTATOR AND PROCESS FOR ITS MANUFACTURE

[75] Inventors: Joze Potocnik, Idrija; Ivan Cerin, Indrija, both of Slovenia

[73] Assignee: Comtrade Handelsgesellschaft mbH, Klagenfurt, Austria

[ * ] Notice: This patent issued on a continued prosecution application filed under 37 CFR 1.53(d), and is subject to the twenty year patent term provisions of 35 U.S.C. 154(a)(2).

[21] Appl. No.: 09/329,811

[22] Filed: Jun. 10, 1999

Related U.S. Application Data

[63] Continuation-in-part of application No. PCT/EP96/05576, Dec. 12, 1996.

[51] Int. Cl.[7] ..... H01R 39/16

[52] U.S. Cl. ..... 310/235

[58] Field of Search ..... 310/233, 234, 310/235, 236, 42, 43; 29/597

[56] References Cited

U.S. PATENT DOCUMENTS

| | | | |
|---|---|---|---|
| 3,253,172 | 5/1966 | Taylor et al. | 310/235 |
| 4,056,882 | 11/1977 | Letts | 29/597 |
| 4,559,464 | 12/1985 | Stokes | 310/233 |
| 4,562,369 | 12/1985 | Gerlach et al. | 310/235 |
| 4,598,463 | 7/1986 | Gerlach et al. | 29/597 |
| 4,868,440 | 9/1989 | Gerlach et al. | 310/236 |
| 5,008,577 | 4/1991 | Wang | 310/236 |
| 5,124,609 | 6/1992 | Nagasaka | 310/236 |
| 5,369,326 | 11/1994 | Strobl | 310/235 |
| 5,442,849 | 8/1995 | Strobl | 29/597 |
| 5,497,042 | 3/1996 | Nettelhoff | 310/236 |
| 5,602,438 | 2/1997 | Reisnecker et al. | 310/236 |
| 5,637,944 | 6/1997 | Shimoyama | 30/237 |
| 5,736,804 | 4/1998 | Potocnik et al. | 310/235 |
| 5,760,517 | 6/1998 | Stolpmann | 310/236 |
| 5,895,990 | 4/1999 | Lau | 310/236 |
| 5,912,523 | 6/1999 | Ziegler et al. | 29/597 |
| 5,925,961 | 7/1999 | Sugiyanma | 310/235 |
| 5,925,962 | 7/1999 | Kobmanet et al. | 310/236 |
| 5,932,949 | 8/1999 | Ziegler et al. | 310/236 |

FOREIGN PATENT DOCUMENTS

| | | | |
|---|---|---|---|
| 0350855 | 7/1989 | European Pat. Off. | H01R 43/06 |
| 2537792 | 6/1984 | France | H02R 39/14 |
| 2670334 | 6/1992 | France | H01R 39/04 |
| 2686463 | 7/1993 | France | H01R 39/04 |
| 0599911 | 6/1934 | Germany . | |
| 0918458 | 9/1954 | Germany . | |
| 1056256 | 4/1959 | Germany . | |
| 3823845 | 1/1990 | Germany | H01R 39/14 |
| 56-136159 | 10/1981 | Japan | H02K 13/00 |
| 0393507 | 11/1965 | Switzerland . | |
| 0464334 | 12/1968 | Switzerland | H01R 39/14 |
| 0902557 | 8/1962 | United Kingdom . | |
| 1312059 | 4/1973 | United Kingdom | H01R 39/04 |
| 95/17031 | 6/1995 | WIPO | H01R 43/06 |
| 95/22184 | 8/1995 | WIPO | H01R 43/06 |

*Primary Examiner*—Clayton LaBalle
*Attorney, Agent, or Firm*—Klein & Szekeres, LLP

[57] ABSTRACT

A commutator (10, 110, 210) with a reinforcing system comprising a stepped insulating ring (20, 120, 220) with a support piece (22, 122, 222) and a center or flange piece (24, 124, 224) and a metal ring (18,118, 218) which has a rectangular cross-section and is fitted into the stepped shape of the insulating ring such that part of the radial outer surface of the metal ring abuts the radial inner surface of the center or flange piece, and the end inner surface of the metal ring completely abuts the end outer surface of the support piece.

14 Claims, 3 Drawing Sheets

COMMUTATOR AND PROCESS FOR ITS MANUFACTURE

CROSS-REFERENCE TO RELATED APPLICATION

This application is a Continuation-in-Part of International Application No. PCT/EP96/05576, filed Dec. 12, 1996.

FEDERALLY SPONSORED RESEARCH OR DEVELOPMENT

Not Applicable

BACKGROUND OF THE INVENTION

The invention involves a commutator with copper segments embedded in plastic, which at the very least engage a receptacle in a reinforcing ring, arranged coaxially with the axis of rotation of the commutator, which comprises a metal ring as well as an insulating ring assembled with the metal ring. The invention further involves a process for the manufacture of such a commutator, having a body comprising copper segments, with at least one receptacle for a reinforcing ring fabricated from a metal ring and an insulating ring, the reinforcing ring introduced into this receptacle and the commutator subsequently cast with plastic.

Numerous implementations of commutators reinforced with fiberglass reinforcing rings are well-known. Despite the considerable advantages of these commutators—for example, fiberglass rings exhibit favorable expansion characteristics and are readily prestressed or reinforced, and furthermore, fiberglass rings can be slipped directly onto copper armature retainers, because the reinforcing rings are also electrical insulators—they still have a disadvantage compared with commutators reinforced with steel rings. This disadvantage manifests itself when these commutators are used in motors at high heat loads or for long operating times under high temperature conditions. It is also possible that any sort of defect can result in a thermal overload. With all thermal overloads, a local softening of the insulating or fiberglass rings can occur if low-cost resins are used. A consequence of this is that the commutator segments can be distorted beyond their tolerance limits, whereby the lifetime of such commutators can be considerably decreased.

Commutators have therefore already been proposed, in which the reinforcing ring consists of at least one metal ring of essentially rectangular cross section, which engages an insulating ring of essentially rectangular cross section. By way of example, one such commutator is well known from German Patent Publication No. DE-OS 4302759. This publication discloses a commutator for an electric motor with fan-shaped copper lamina arranged on its circumference, which is anchored by means of internal lands engaging undercuts in an insulating carrier made of a plastic molding compound. At least one reinforcing ring including a metallic tension ring is thereby enclosed within the carrier, wherein the internal lands engage projections in the region of the undercuts and at the very least produce an insulating intermediate layer on its inner side with respect to the projections. Moreover, the intermediate layer consists of a support ring, closely fitted to the tension ring, and made of a material which is both an insulating material and compression resistant at elevated operating temperatures.

Because a press fit is provided between the tension and support rings, whereby the tension ring and the support ring form a reinforcing ring as a rigid and solid unit, both rings must be fabricated to high-precision dimensions and consequently very close manufacturing tolerances prior to their assembly, so that a constant compressive force between the two rings, as well as a corresponding clearance precision within the undercuts, can always be assured. An additional result is that in the case where the support ring is made of glass, pre-stressing to enable the press fit is only attainable at very high manufacturing costs. Furthermore, it is possible that in applications using a fiberglass ring, the latter can soften at high temperatures if inexpensive, non-heat-resistant resins are used, which at the very least could lead to damaging this reinforcing ring comprising a fiberglass ring and a metal ring. Additionally, the insulating ring or glass ring arranged between the hub and the metal ring can no longer be pre-stressed when installed within the commutator.

A commutator of the above-described type is well known from International Publication Nos. WO95/22184 and WO95/22185. These publications deal with the manufacture of a commutator reinforcing ring assembled from a metal ring and a fiberglass ring. A metal ring of rectangular cross section is thereby pressed endwise into a fiberglass ring of nearly rectangular cross section; in this way, the fiberglass ring is deformed in such a way that a projecting area results, which is displaced on the metal ring and is adjacent to a radial outer surface of the metal ring, whereby a centering or flanged part results. Moreover, the generic state of the art is represented by FIGS. 3 and 6 of WO95/22184 or FIGS. 3 and 7 of WO95/22185. Importantly, there is a clearance between the metal ring and the armature retainer of the copper segments which is filled with plastic. Apart from this, the state of the art is represented by German Patent Publication No. DE-43027159-A, wherein a first part of the radial outer surface of the armature retainer presses firmly against the metal ring of the reinforcing ring across an intermediate layer of high-temperature, compression-resistant plastic.

Underlying the present invention is the problem of specifying a commutator of the type described above, which exhibits an even greater torsional strength at high operating temperatures as well as at high rotational velocities, by technically straightforward means, being at the same time easily manufactured and also still able to take advantage of the expansion characteristics of the insulation ring. Further underlying the invention is the problem of specifying a process of the type described above, which makes possible the manufacture of a commutator with further improved torsional strength at high temperatures and rotational velocities, and which together greatly simplifies its manufacturing process.

SUMMARY OF THE INVENTION

The problems of the prior art are solved by a commutator in accordance with the present invention, wherein the support piece of the insulating ring exhibits a smaller inside diameter than the metal ring and wherein a second piece, attached to the first part of the radial outer surface of the armature retainer, independently upholds the support piece of the insulating ring. Essentially, for the commutator according to the invention, the support piece of the insulating ring, due to its smaller inside diameter with respect to the metal ring, is directly supported by the radial outer surface of the armature retainer along its entire axial length. In this way there results an optimized redundant reinforcing system, in which the metal ring and the support piece of the insulating ring are ideally spatially separated. Each part of the radial outer surface of the armature retainer functionally bears, each along its axial length on the armature retainer, and completely independent of the other parts, the load which arises from the effects of the centrifugal force of the copper segments. In this way, there results a further improved torsional strength in the commutator, both at high temperatures and under high rotational velocities. In particular, the danger that the fiberglass ring might break during assembly of the commutator and/or during operations, is practically eliminated.

More specifically, the present invention pertains to a commutator with copper segments embedded in plastic, wherein at least one surface engages a receptacle on a reinforcing ring arranged coaxially with the axis of rotation of the commutator, which consists of a metal ring of rectangular cross section as well as an insulating ring of rectangular cross section assembled to the metal ring, wherein the insulating ring consists, from the inside out, as viewed in the axial direction, of a support piece as well a center-or flange-piece attached to it radially outward and axially displaced, both of them formed together and exhibiting a step form. Moreover, the metal ring is fitted into the step-form of the insulating ring so that a part the radial outer surface of the metal ring is adjacent to the radial inner surface of the flange-piece, and the inner surface of the metal ring completely adjoins the outer surface of the support piece. The reinforcing ring thereby forms a multiple reinforcing system in such a way that the metal ring and the support piece of the insulating ring are spatially separated and independent of each other, each bearing on its axial dimension the load from the armature retainer which is caused by the centrifugal force of the copper segments, wherein a first part of the radial outer surface of the armature retainer bears against the metal ring through a high-temperature, compression-resistant plastic, as viewed from the outside in, in the axial direction, whereas a second part of the radial outer surface of the armature retainer, attached to it axially inward, independently supports the support piece of the insulation ring.

The production process according to the present invention uses the especially advantageous manufacturing method of the reinforcing ring by front compressing at least one metal ring of essentially rectangular cross section first with an insulating ring of essentially rectangular cross section in such a way that the insulating ring, as viewed from the inside out in an axial direction, consists of a support piece as well as a centering or flanged part attached to it radially outward and axially displaced, both being formed solidly together and thereby exhibiting a stepped form, wherein the metal ring is installed into the stepped form of the insulating ring in such a way that at least one part of the radial outer surface of the metal ring is adjacent to the radial inner surface of the flanged part, and one flat surface of the metal ring completely abuts a flat surface of the support piece.

In addition, the solutions according to the invention have the advantage that for the assembled ring only about half the otherwise usual axial lengths of the insulating ring and the steel or metal rings are used, which leads to non-trivial material savings. Because the metal ring, as well as the insulating ring, can be produced with relatively loose dimensional tolerances, the manufacturing costs of the reinforcing ring have also been drastically reduced.

One especially favored and low-cost variation is thereby specified, in which the insulating ring is a fiberglass ring, but low-cost and consequently non-high-temperature or non-heat-resistant resins can nevertheless be used.

With the exception of flat commutators it is necessary to provide for such reinforcement on both faces of the commutator. Furthermore, it is advantageous if only the support piece of the insulating ring is pre-stressed against the indicated radially outward part of the armature retainer, independent of the metal ring. This could be accomplished, for example, by forming this indicated outside area of the radial outer surface of the armature retainer tilted toward the axis of rotation.

Although the foregoing description essentially involves a normal segmented commutator (drum- or cylinder-commutator), the invention is not limited to such commutators. Thus it is certainly also possible to utilize the solution according to the invention with a flat commutator, i.e. it can use the same reinforcing ring and be embedded within the receptacle in the same way.

Pursuant to an additional embodiment, it is also possible that the metal ring can be made in the shape of a circular washer and exhibit a coaxial extension groove which engages the adjacent part on the metal ring. This improvement is especially advantageous for flat commutators, because the tilting of the flat commutator is effectively prevented by this configuration of the metal ring.

It is also advantageous here if the insulating ring is formed stepwise with a support piece and a flanged part, whereby the flanged part engages the axially-displaced groove in the metal ring, the space between the inner circumferential surface of the metal ring and the copper segments arranged adjacent to the axis of rotation being filled with plastic, which is a part of the insulating body of the flat commutator.

The metal ring can be manufactured quite easily. For example, it can be stamped out of sheet metal. This is possible because of the small axial dimension of the metal ring. The metal ring could also be made by cutting lengths off a metal tube. The relatively small axial dimension is also advantageous in this case because more metal rings can be sliced off from a metal tube of a given length. So that this advantage is not lost but rather enhanced, the insulating ring is preferably fabricated as a fiberglass ring, manufactured by the appropriate winding of glass fibers with the addition of synthetic resin, or by cutting from a fiberglass tube. It is also possible to use a fiberglass tube here, which can then be cut into fiberglass rings of smaller axial dimension.

Moreover, it is also quite possible to form the metal ring in the shape of a circular washer having a coaxial extension groove, into which the part adjacent to the metal ring is engaged when the parts are pressed together. As a result, the cross section of this metal ring exhibits a higher resisting moment. Although a multiplicity of different ways of manufacturing this groove is available, on a cost basis it is preferable to emboss the groove in the metal ring in such a way that an annular projection arises on the opposite side of the metal ring.

An additional advantage of the commutator according to the invention is that the reinforcing ring can be supported directly by the copper segments on both sides of the ring. This makes it possible to drive the reinforcing ring directly into the grooves of the copper segment, or, in the case of a flat commutator, to push it against the seat, whereby the reinforcing ring lies against the copper segments, and the copper segments can thereby be aligned into exact radial positions.

Another advantage of this commutator according to the invention is that only the support piece of the insulating ring is pre-stressed independently from the metal ring.

BRIEF DESCRIPTION OF THE DRAWINGS

In the following, the invention will be further elucidated by means of preferred embodiments, with reference to the drawings, in which.

DETAILED DESCRIPTION OF THE INVENTION

Figure 1:
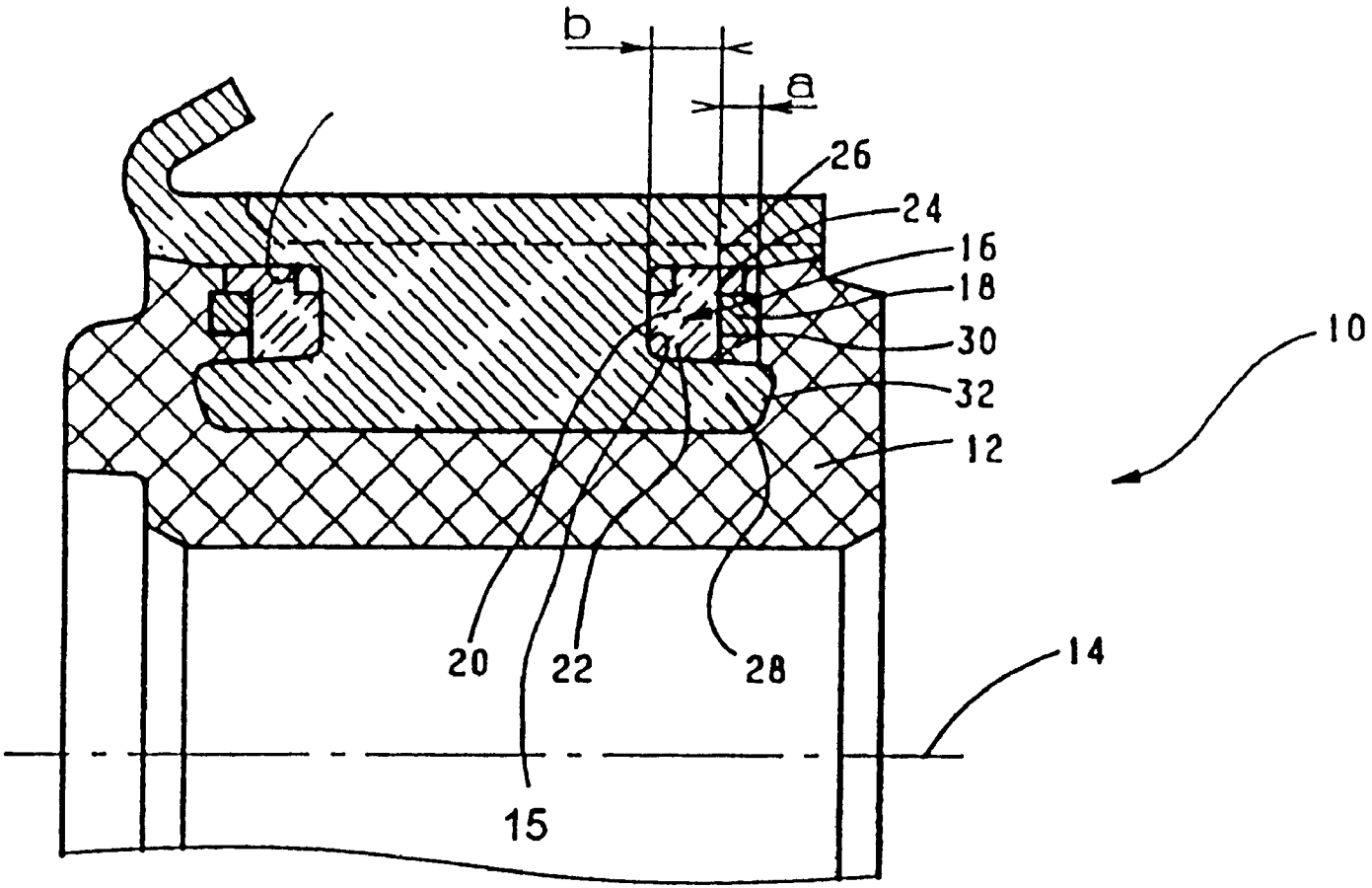
FIG. 1 is a partial cross section through a commutator with a reinforcing ring pursuant to a first embodiment of the invention.

FIG. 1 shows a partial cross section through a commutator 10, whose copper segment 26 is cast or embedded in plastic element 12, and which can rotate about an axis of rotation 14 during operation of the commutator 10. To increase the torsional strength, the commutator 10 is provided with a reinforcing ring 16, which consists of a metal ring 18 and an insulating ring 20, on at least one, but preferably on both surfaces. At the same time, the reinforcing ring 16 engages one of the available receptacles 15 in the copper segment 26. In this preferred embodiment, the receptacle 15 is grooved and is fashioned from undercuts in the individual copper segment 26. Although several preferred embodiments are available, a fiberglass ring 20 is favored as the insulating ring. The copper segment 26 exhibits an armature retainer 28 on its side nearest the axis of rotation which forms a part of the receptacle 15 for the reinforcing ring 16.

As can be seen from FIG. 1, the fiberglass ring 20 is constructed in a stepwise fashion and exhibits a support piece 22, which adjoins the radial outer surface of the armature retainer 28, as well the base of the receptacle 15. In the example shown in FIG. 1, the support piece 22 adjoins only the radial outer surface of the armature retainer 28.

A center or flange piece 24 of the fiberglass ring 20 is attached to the support piece 22 in such a way that this flange piece 24 is displaced axially relative to the support piece 22 and consequently exhibits a stepped form. Furthermore, the radial outer surface of the flange piece 24 adjoins the radial inner surface of the copper segment 26.

In the step formed by the support piece 22 and the flange piece 24, the metal ring 18 is engaged in such a way that its radial outer surface partially adjoins the flange piece 24, whereas its axially-inward-directed surface completely adjoins the support piece 22. Since a space is formed between the radial inner surface of the metal ring 18 and the radial outer surface of the armature retainer 28, this can be filled with an intermediate layer 30 of plastic 12.

As shown in FIG. 1, the axial outer surface of the armature retainer 28 forms a first part a, as viewed from the outside in, by means of which the armature retainer 28 bears against the metal ring 18 through the high-temperature compression-resistant intermediate layer 30 of the plastic 12, while a second part b, internally adjoining it, is essentially adjacent to the radial inner surface of the support piece 22.

Figure 2:
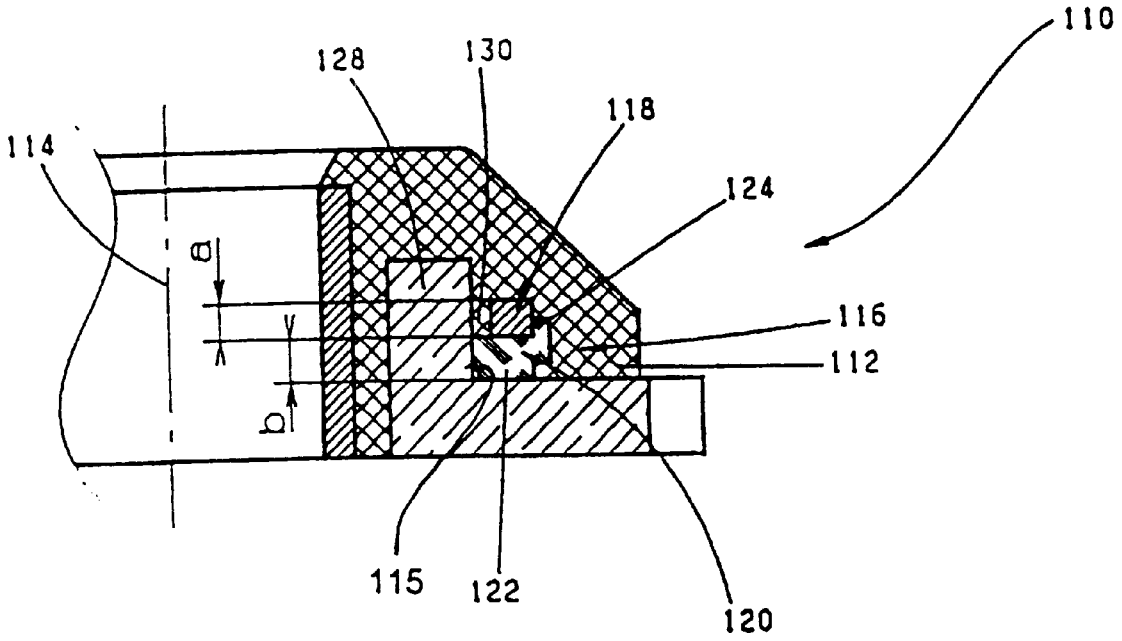
FIG. 2 is a partial cross section through a flat commutator with the same reinforcing ring as shown in FIG. 1.

In FIG. 2 is depicted a partial cross section of a flat commutator 110, which constitutes a second preferred embodiment of the invention, even though it uses the reinforcing ring shown in FIG. 1. The flat commutator 110 comprises copper segments 126, of L-shaped cross section, whereby the bearing surface of the brushes is perpendicular to the axis of rotation 114 of the flat commutator 110. The armature retainers 128 of the copper segments 126, which together comprise a receptacle 115 for a reinforcing ring 116, lie parallel to the axis of rotation 114.

The reinforcing ring 116 is formed from an insulating ring 120 and a metal ring 118. Moreover the insulating ring 120 is also a fiberglass ring in this example. On the other hand, the fiberglass ring 120 consists of a support piece 122, which adjoins the inward-directed surface of the armature retainer 128, as well as the surface of the copper segment 126 which faces away from the bearing surface of the brushes. Just as in FIG. 1, the fiberglass ring 120 of FIG. 2 also has a center- or flange-piece 124, so displaced axially that the fiberglass ring 120 forms a step as the receptacle for a metal ring 118. Here again there are formed a first part a and also a second part b, which correspond to the same regions in FIG. 1, by which the centrifugal force of the armature retainer 128 is transmitted to the metal ring 118 or the fiberglass ring 120. Moreover, the flat commutator 110 is cast or molded with plastic 112.

Figure 3:
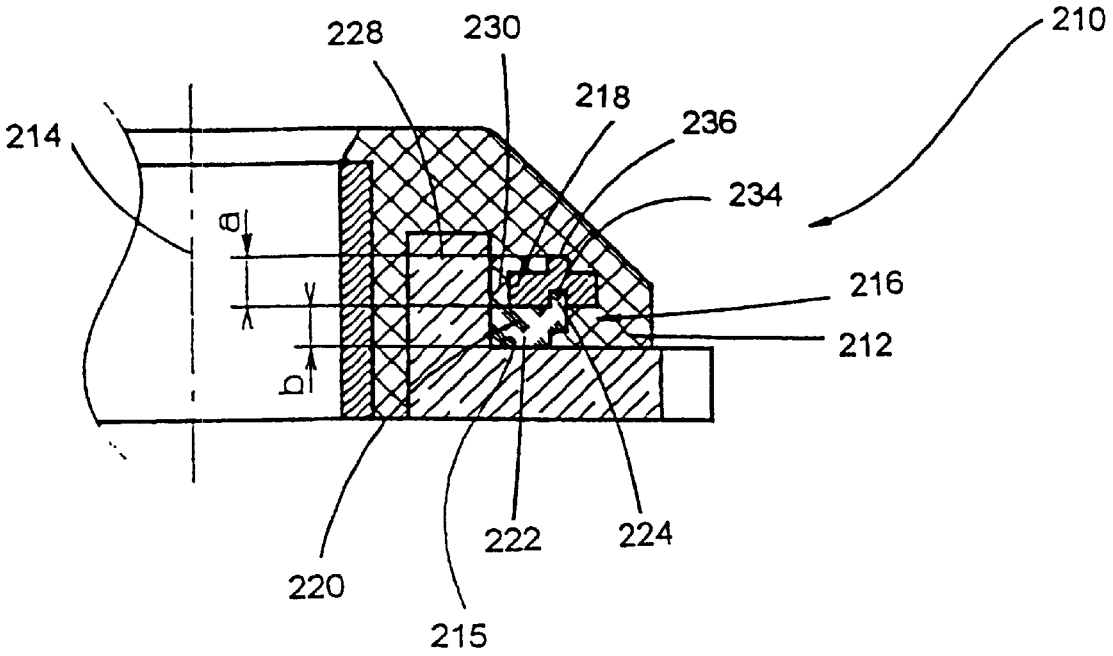
FIG. 3 is partial cross section of a reinforcing ring in accordance with a second embodiment of the invention.

In FIG. 3 is shown an additional preferred embodiment of a commutator, here the flat commutator 210, which includes a reinforcing ring 216 in a receptacle 215. In contrast to the metal rings 18 and 118 of FIGS. 1 and 2, the metal ring 218 of a third preferred embodiment illustrates a different configuration in that it is formed in a target shape and includes a groove 234 coaxial with the axis of rotation 214 and directed towards the bearing surface of the brushes, in which one part of a center- or flange-piece 224 engages an insulating ring 220. It can be seen from FIG. 3 that the metal ring 218 includes a projection 236, in opposition to the groove 234, which prevents the tilting of the flat commutator 210.

Just as in FIG. 1, for the preferred embodiments of FIGS. 2 and 3, high-temperature, compression-resistant layers 130 and 230, which consist of the plastic elements 112 or 212, are also fabricated in both cases.

From FIG. 3 it can readily be seen that the flange-piece 224 is attached stepwise to, and axially displaced with respect to, the support piece 222, whose protruding region engages the groove 234. The segment of the metal ring 218 attached radially outward from the flange-piece 224 serves as an additional support for the portions of the copper segments 226 which form the bearing surfaces of the brushes. Moreover, the surface area to which the plastic element 212 can be attached is thereby increased.

In the following discussion, the procedure for the manufacture of these commutators 10, 110 and 210 will be described. In this process, a body is fabricated comprising copper segments 26, 126 and 226, with at least one seat for a reinforcing ring 16, 116 and 216, wherein the reinforcing ring comprises a metal ring 18, 118 and 218 and an insulating ring 20, 120 and 220. Subsequently, the reinforcing ring 16, 116 and 216 is seated against this surface and the commutator 10, 110 and 210 is then cast or molded with a plastic element 12, 112 and 212. Moreover, the reinforcing ring 16, 116 and 216 is fabricated by means of pressing together the front surfaces of at least one metal ring 18, 118 and 128 of essentially rectangular cross section and the insulating ring 20, 120, 220 of essentially rectangular cross section. This occurs so that at least one flange-piece 24, 124 and 224 of the insulating ring 20, 120 and 220 is displaced from the commutator 10, 110 and 210 in the axial direction from the inside out, and the metal ring 18, 118 or 218 encompasses or engages the groove 234 on its radial outer surface.

Moreover, the manufacture of the metal ring is preferably accomplished by stamping a corresponding metal ring 18, 118, 218 out of sheet metal. This is possible because the axial dimension of the metal ring 18, 118 and 218 is comparatively small. Furthermore, the metal ring 18, 118 and 218 can also be sliced from a metal tube, whereby relatively more metal rings 18, 118 and 218 can be sliced from a tube of given length because of the small axial dimension.

The manufacture of the insulating ring is also very simple, especially if a fiberglass ring 20, 120 and 220 is used as the insulating ring. This fiberglass ring 20, 120 and 220 can be made either by winding glass fibers while feeding a synthetic resin or by slicing a corresponding piece from a fiberglass tube, whereby here also more fiberglass rings can be sliced from a fiberglass tube of a given length based on the small axial dimension.

The manufacture of the reinforcing ring 16, 116 and 216 occurs by simply pressing together the corresponding surfaces of the previously assembled rings without applying any axial tension. Both rings are moved only axially relative to each other, whereby the corresponding flange-piece 24, 124 or 224 can be displaced in shear from the formerly rectangular cross section of the fiberglass ring 20, 120 or 220 relative to the metal ring 18, 118 or 218.

What is claimed is:

1. A commutator (10, 110, 210) having an axis of rotation (14, 114, 214) comprising a plurality of copper segments (26, 126, 226) embedded in a plastic element (12, 112, 212), each of the copper segments forming an armature retainer (28, 128, 228); and at least one reinforcing ring (16, 116, 216) arranged coaxially to the axis of rotation (14, 114, 214) of the commutator being received within a corresponding receptacle (15, 115, 215) of said copper segments, said at least one reinforcing ring comprising a single metal ring (18, 118, 218) and an insulating ring (20, 120, 220) assembled with the metal ring (18, 118, 218), wherein the insulating ring (20, 120, 220) is step-like formed and comprises:

a support piece (22, 122, 222); and a flange piece (24, 124, 224) attached to the support piece radially outward and axially displaced, both the support piece and the flange piece being formed from a single unit, and wherein the metal ring (18, 118, 218) is fitted into the step-like insulating ring (20, 120, 220) so that a portion of the radial outer surface of the metal ring (18, 118, 218) is adjacent to the radial inner surface of the flange piece (24, 124, 224), and a flat face of the metal ring (18, 118, 218) abuts a flat face of the support piece (22, 112, 222);

whereby the reinforcing ring (16, 116, 216) forms a redundant reinforcing system so that the metal ring (18, 118, 218) and the support piece (22, 122, 222) are spatially separated and independent of each other, each bearing along its respective axial position the load from the armature retainers (28, 128, 228) of the copper segments which results from the effects of the centrifugal force of the copper segments (26, 126, 226); and wherein a first part (a) of the radial outer surface of the armature retainers (28, 128, 228) presses against the metal ring (18, 188, 218) in the radial direction across a high temperature, compression-resistant intermediate layer (30, 130, 230) of the plastic element (12, 112, 212), whereas a second part (b) of the radial outer surface of the of the armature retainers arranged in the axial direction adjacent to said first part (a) presses against said support piece (22, 122, 222), said support piece immediately adjacent to the metal ring having a smaller inside diameter than the metal ring, there being no part of the plastic element between the radially inner surface of the support piece and the adjacent portion of the armature retainers, and further there being exclusively plastic material of the plastic element present between the radially inner surface of the metal ring and the adjacent portion of the armature retainers.

2. A commutator as claimed in claim 1, further characterized in that the commutator is a flat commutator.

3. A commutator as claimed in claim 2, further characterized in that the metal ring (218) is shaped like a circular washer and has a coaxial extension groove (234), which engages the flange piece (224) adjacent to the metal ring (218), and which has an annular projection (236) formed on the side of the metal ring (218) opposite the groove (234).

4. A commutator as claimed in claim 1, further characterized in that it is formed as a cylindrical commutator, wherein two reinforcing rings (16) are provided, each arranged in a flat-faced receptacle (15).

5. A commutator as claimed in claim 4, further characterized in that, as viewed in an axial direction, the support piece (22) of the insulating ring (20) is positioned inwardly, and the flange piece (24) is positioned outwardly.

6. A commutator according to any of claims 1, 2, 3, 4 or 5, further characterized in that, during the formation of the reinforcing ring, the metal ring and the insulating ring are assembled together by axially forcing the metal ring into the insulating ring which originally exhibited a primarily rectangular cross section during formation of the flange piece.

7. A commutator according to any of claims 1, 2, 3, 4 or 5, further characterized in that only the support piece is pre-stressed against the radially outer part of the armature retainer, independent of the metal ring.

8. A commutator according to any of claims 1, 2, 3, 4 or 5, further characterized in that the insulating ring is a fiberglass ring.

9. A process for manufacturing a commutator (10, 110, 210) comprising a plurality of copper segments (26, 126, 226) including armature retainers (28, 128, 228), with at least one receptacle (15, 115, 215) for a reinforcing ring (16, 116, 226) made from a single metal ring (18, 118, 218) and an insulating ring (20, 120, 220), the reinforcing ring being introduced into the receptacle and the commutator subsequently being cast with a plastic element (12, 112, 212), whereby the reinforcing ring is fabricated by a method comprising the steps of:

(A) providing an insulating ring of substantially rectangular cross section;

(B) pressing a face of the metal ring into the insulating ring in such a way that the insulating ring deforms by forming a support piece (22, 122, 222) as well as a flange piece (24, 124, 224) attached to it in a radially outward and axially displaced manner, both of them formed in one piece; and (C) fitting the metal ring into the insulating ring so that a portion of the radial outer surface of the metal ring is adjacent to the radial inner surface of the flange piece, and a flat face of the metal ring abuts a flat face of the support piece, whereby the reinforcing ring forms a redundant reinforcing system in such a way that the metal ring and the support piece are spatially separated and functionally independent from each other, each bearing along its axial position the load of the armature retainers, which arises from the effects of the centrifugal force of the copper segments, whereby the reinforcing ring (16, 116, 216) forms a redundant reinforcing system so that the metal ring (18, 118, 218) and the support piece (22, 122, 222) are spatially separated and independent of each other, each bearing along its respective axial position the load from the armature retainers (28, 128, 228) of the copper segments which results from the effects of the centrifugal force of the copper segments (26, 126, 226), and wherein a first part (a) of the radial outer surface of the armature retainers (28, 128, 228) presses against the metal ring (18, 188, 218) in the radial direction across a high-temperature, compression-resistant intermediate layer (30, 130, 230) of the plastic element (12, 112, 212), whereas a second part (b) of the radial outer surface of the of the armature retainers arranged in the axial direction adjacent to said first part (a) presses against said support piece (22, 122, 222), said support piece immediately adjacent to the metal ring having a smaller inside diameter than the metal ring, there being no part of the plastic element between the radially inner surface of the support piece and the adjacent portion of the armature retainers, and further there being exclusively plastic material of the plastic element present between the radially inner surface of the metal ring and the adjacent portion of the armature retainers.

10. A process for the manufacture of a commutator as claimed in claim 9, further comprising the step of forming the metal ring by a method selected from the group consisting of stamping the metal ring from sheet metal, and cutting the metal ring from a metal tube.

11. A process for the manufacture of a commutator according to either of claims 9 or 10, wherein the insulating ring is a fiberglass ring, and wherein the process further comprises the step of manufacturing the fiberglass ring by a step selected from the group consisting of winding glass fibers while feeding a synthetic resin, and cutting a ring from a fiberglass tube.

12. A process for the manufacture of a commutator according to either of claims 9 or 10, wherein, after the insertion of the reinforcing ring, only the support piece is pre-stressed on the indicated radially outer portion of the armature retainer, independent from the metal ring.

13. A process for the manufacture of a commutator according to either of claims 9 or 10, wherein the commutator is a flat commutator (210), and wherein the metal ring (218) is formed in the shape of a circular washer having a coaxial extension groove (234) into which the part (224) adjacent to the metal ring (218) can be engaged during the pressing together, the process further comprising the step of embossing the groove into the metal ring (218) in such a way that in the process an annular projection (236) results on the opposite side of the metal ring (218).

14. A process for the manufacture of a commutator (210) as claimed in claim 13, wherein the insulating ring (220) during the pressing together with the metal ring is formed so as to comprise a support piece (222) and a flange piece (224), whereby the flange piece (224) engages the groove (234) of the metal ring (218) with an axial displacement, and wherein the space between the inner circumferential surface of the metal ring (218) and the sides of the copper segments (226) arranged adjacent to an axis of rotation (214) are subsequently filled with plastic (212), which is a part the insulating body of the flat commutator (210).

* * * * *